US011450965B2

(12) United States Patent
Shibata

(10) Patent No.: US 11,450,965 B2
(45) Date of Patent: Sep. 20, 2022

(54) PATCH ANTENNA

(71) Applicant: TDK Corporation, Tokyo (JP)

(72) Inventor: Tetsuya Shibata, Tokyo (JP)

(73) Assignee: TDK CORPORATION, Tokyo (JP)

( * ) Notice: Subject to any disclaimer, the term of this patent is extended or adjusted under 35 U.S.C. 154(b) by 393 days.

(21) Appl. No.: 16/202,086

(22) Filed: Nov. 28, 2018

(65) Prior Publication Data

US 2019/0165475 A1 May 30, 2019

(30) Foreign Application Priority Data

Nov. 29, 2017 (JP) ..... JP2017-229350

(51) Int. Cl.

| | |
|---|---|
| ***H01Q 1/48*** | (2006.01) |
| ***H01Q 19/00*** | (2006.01) |
| ***H01Q 9/04*** | (2006.01) |
| *H01Q 21/06* | (2006.01) |

(52) U.S. Cl.

CPC ..... *H01Q 9/045* (2013.01); *H01Q 1/48* (2013.01); *H01Q 19/005* (2013.01); *H01Q 9/0435* (2013.01); *H01Q 21/065* (2013.01)

(58) Field of Classification Search

CPC ..... H01Q 9/045; H01Q 19/005; H01Q 1/48; H01Q 9/0435; H01Q 21/065; H01Q 1/38; H01Q 1/50; H01Q 13/08

See application file for complete search history.

(56) References Cited

U.S. PATENT DOCUMENTS

| | | | | |
|---|---|---|---|---|
| 5,907,305 | A * | 5/1999 | Epp | H01Q 1/38 343/700 MS |
| 5,995,047 | A | 11/1999 | Freyssinier et al. | |
| 6,181,278 | B1 * | 1/2001 | Kakimoto | H01Q 9/0457 343/700 MS |
| 2005/0088260 | A1 | 4/2005 | Ajioka et al. | |
| 2006/0256030 | A1 | 11/2006 | Unmehara | |

(Continued)

FOREIGN PATENT DOCUMENTS

| | | |
|---|---|---|
| CN | 101106215 A | 1/2008 |
| CN | 104681971 A | 6/2015 |

(Continued)

OTHER PUBLICATIONS

Nanqiang series of Xiamen University—Practical Design Techniques for Modern Antennas, Baiqiang You, et al., Xiamen University Press, pp. 23, Sep. 20, 2016 (with English translation), 2 pages.

*Primary Examiner* — Hai V Tran
*Assistant Examiner* — Michael M Bouizza
(74) *Attorney, Agent, or Firm* — Young Law Firm, P.C.

(57) ABSTRACT

Disclosed herein is a patch antenna that includes a first dielectric layer in which a patch conductor is provided, a second dielectric layer in which a signal line extending in a direction parallel to the patch conductor is provided, a feed conductor provided perpendicularly to the patch conductor so as to connect one end of the signal line and a feed point for the patch conductor, a first ground pattern provided between the patch conductor and the signal line, and a second ground pattern provided on an opposite side to the first ground pattern with respect to the signal line. The first dielectric layer has a dielectric constant lower than that of the second dielectric layer.

20 Claims, 11 Drawing Sheets

(56) References Cited

U.S. PATENT DOCUMENTS

| | | | | |
|---|---|---|---|---|
| 2007/0279143 | A1* | 12/2007 | Itsuji | H01Q 1/38 331/185 |
| 2014/0198013 | A1 | 7/2014 | Saraswat et al. | |
| 2015/0194730 | A1* | 7/2015 | Sudo | H01Q 1/38 343/905 |
| 2020/0220270 | A1* | 7/2020 | Onaka | H01Q 9/045 |

FOREIGN PATENT DOCUMENTS

| | | | |
|---|---|---|---|
| JP | H02107003 | A | 4/1990 |
| JP | P2001-267833 | A | 9/2001 |
| JP | 6122508 | A | 3/2016 |
| JP | 2016163120 | A | 9/2016 |

* cited by examiner

PATCH ANTENNA

BACKGROUND OF THE INVENTION

Field of the Invention

The present invention relates to a patch antenna and, more particularly, to a patch antenna in which a patch conductor and a signal line are formed in the same dielectric block.

Description of Related Art

A patch antenna has a structure in which a ground pattern and a patch conductor are provided, respectively, on the front and back sides of a dielectric layer. Japanese Patent No. 6,122,508 and JP 2016-163120 A disclose a patch antenna provided further with a wiring layer including a signal line.

However, characteristics required for the dielectric material in which the patch conductor is formed and those required for the dielectric material in which the signal line is formed are not always the same. Thus, when a dielectric block is constituted by using a single dielectric material, it is difficult to miniaturize the signal line.

JP 1990-107003 A discloses a patch antenna using a plurality of dielectric layers having mutually different dielectric constants. However, J P 1990-107003 A does not describe a method of miniaturizing the signal line while ensuring high antenna characteristics.

SUMMARY

It is therefore an object of the present invention to provide a patch antenna capable of miniaturizing the signal line while ensuring high antenna characteristics.

A patch antenna according to the present invention includes: a first dielectric layer in which a patch conductor is provided; a second dielectric layer in which a signal line extending in a direction parallel to the patch conductor is provided; a feed conductor provided perpendicularly to the patch conductor so as to connect one end of the signal line and a feed point for the patch conductor; a first ground pattern provided between the patch conductor and the signal line; and a second ground pattern provided on the side opposite to the first ground pattern with respect to the signal line. The first dielectric layer has a dielectric constant lower than that of the second dielectric layer.

According to the present invention, the dielectric constant of the first dielectric layer is relatively low, allowing antenna's gain to be improved. Further, the dielectric constant of the second dielectric layer is relatively high, allowing the line width of the signal line required for obtaining predetermined characteristic impedance to be reduced. Thus, it is possible to miniaturize the signal line while ensuring high antenna characteristics. The signal line may be a microstrip-line, a stripline, or a coplanar waveguide line.

In the present invention, the first ground pattern may be disposed on the boundary surface between the first and second dielectric layers. By thus forming the first ground pattern on the surface of the first or second dielectric layer, a patch antenna can be produced.

In the present invention, the patch conductor may be disposed on the outermost surface of the first dielectric layer, and the second ground pattern may be disposed on the outermost surface of the second dielectric layer. This allows a reduction in the number of the dielectric layers.

The patch antenna according to the present invention may further have a parasitic patch conductor provided in the first dielectric layer so as to overlap the patch conductor. This allows antenna bandwidth to be further extended.

The patch antenna according to the present invention may further have another signal line provided in the second dielectric layer and another feed conductor provided perpendicularly to the patch conductor and connecting one end of the another signal line and another feed point for the patch conductor. This allows a dual-polarized antenna to be obtained.

In the present invention, a plurality of sets of the patch conductor, signal line, and feed conductor may be provided in an array. This allows a so-called phased array antenna to be obtained.

In the present invention, the second dielectric layer may have a first region and a second region having a thickness smaller than that of the first region, the first dielectric layer may be provided on the first region of the second dielectric layer, and the signal line may be formed over the first and second regions of the second dielectric layer. This allows the second region of the second dielectric layer to have flexibility.

Thus, according to the present invention, there can be provided a patch antenna capable of miniaturizing the signal line while ensuring high antenna characteristics.

BRIEF DESCRIPTION OF THE DRAWINGS

The above and other objects, features and advantages of this invention will become more apparent by reference to the following detailed description of the invention taken in conjunction with the accompanying drawings, wherein.

DETAILED DESCRIPTION OF THE EMBODIMENTS

Preferred embodiments of the present invention will be explained below in detail with reference to the accompanying drawings.

First Embodiment

Figure 1:
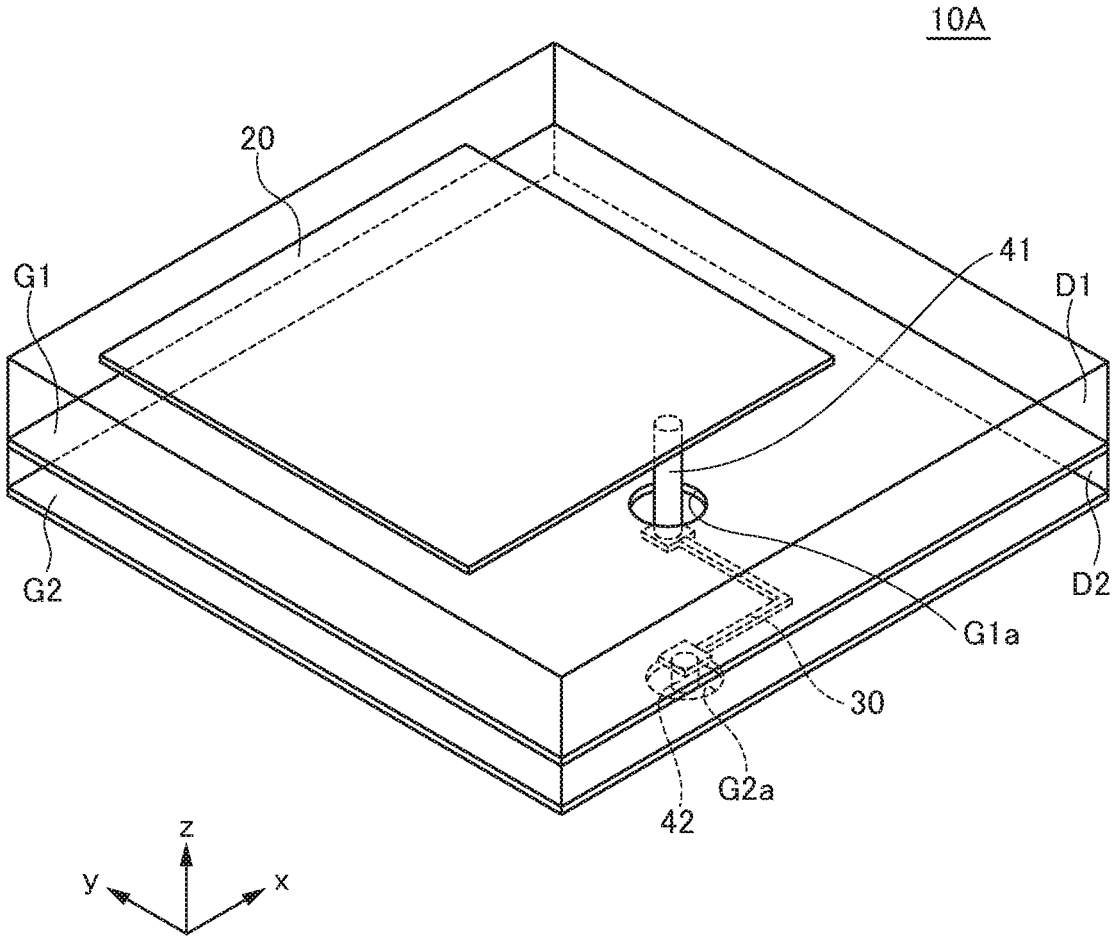
FIG. 1 is a schematic transparent perspective view of a patch antenna according to a first embodiment of the present invention.
Figure 2:
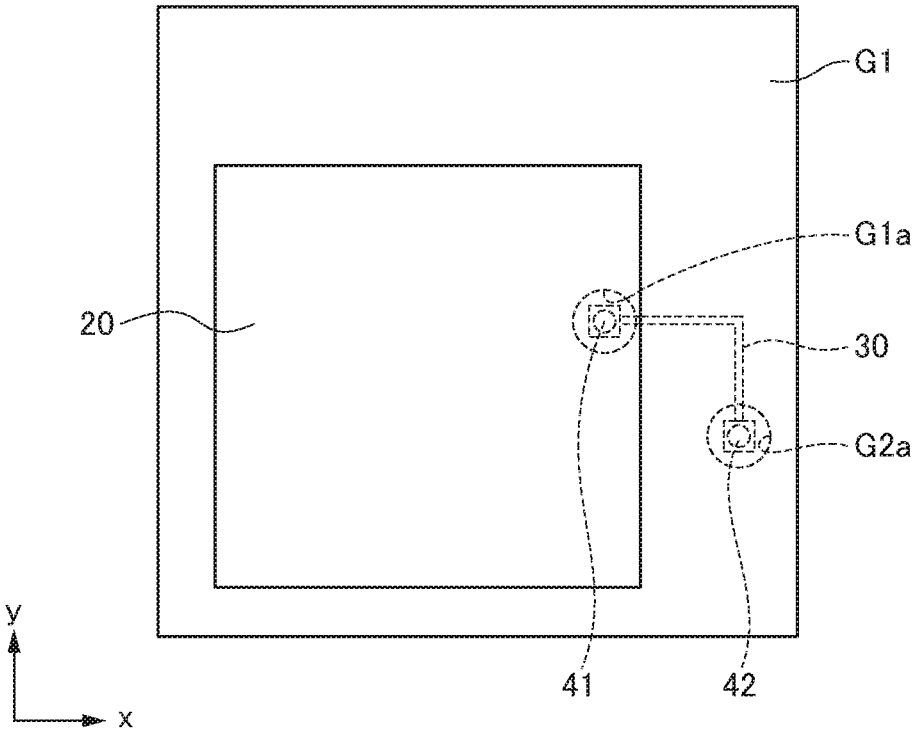
FIG. 2 is a schematic transparent plan view of the patch antenna shown in FIG. 1.
Figure 3:
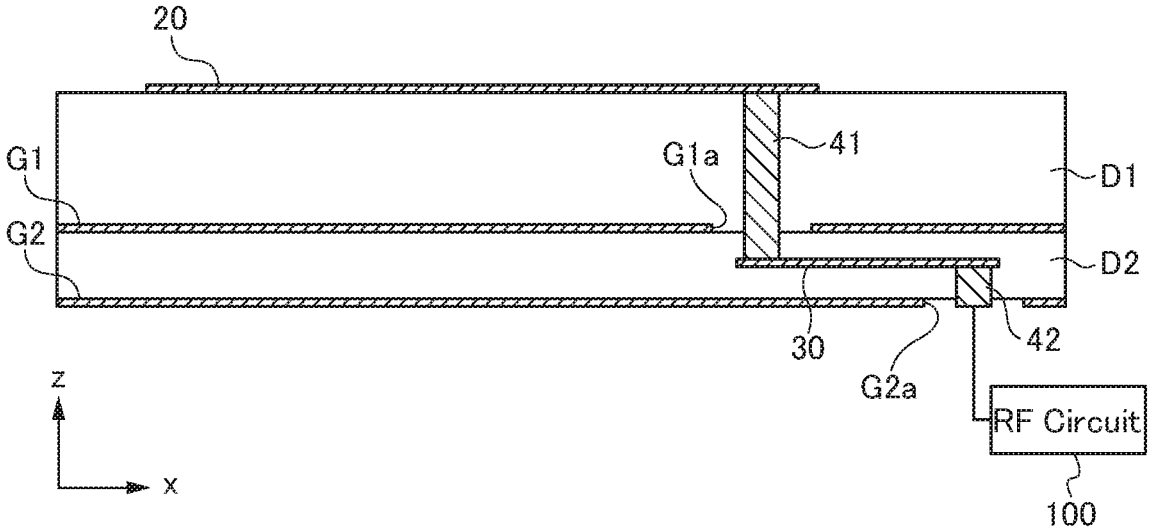
FIG. 3 is a schematic transparent side view of the patch antenna shown in FIG. 1.

FIG. 1 is a schematic transparent perspective view of a patch antenna 10A according to the first embodiment of the present invention. FIG. 2 is a schematic transparent plan view of the patch antenna 10A, and FIG. 3 is a schematic transparent side view of the patch antenna 10A.

The patch antenna 10A according to the present embodiment is an antenna device that performs wireless communication using a millimeter wave band. As illustrated in FIGS. 1 to 3, the patch antenna 10A includes first and second dielectric layers D1 and D2, a patch conductor 20 formed on the outermost surface of the first dielectric layer D1, a first ground pattern G1 provided on the boundary surface between the first and second dielectric layers D1 and D2, and a second ground pattern G2 formed on the outermost surface of the second dielectric layer D2. The first ground pattern G1 is formed along the entire xy plane except for an opening G1*a*. Similarly, the second ground pattern G2 is formed over the entire xy plane except for an opening G1*a*. The patch conductor 20 is formed along the xy plane on the outermost surface of the first dielectric layer D1 and thus faces the first ground pattern G1 through the first dielectric layer D1. The first ground pattern G1 serves as a reference plane with respect to the patch conductor 20.

As the material of the first and second dielectric layers D1 and D2, a resin material, a ceramic material such as LTCC, a liquid crystal polymer, etc. can be used. Although the specific material thereof is not particularly limited, it is at least necessary that the dielectric constant of the first dielectric layer D1 be lower than the dielectric constant of the second dielectric layer D2. For example, it is possible to use a resin material with a low dielectric constant for the first dielectric layer D1 and to use a liquid crystal polymer with a higher dielectric constant and excellent in high frequency characteristics for the second dielectric layer D2.

A signal line 30 extending along the xy plane is provided inside the second dielectric layer D2. The signal line 30 is provided for feeding an antenna signal to the patch conductor 20. As the signal line 30, a microstripline, a stripline, a coplanar waveguide line, etc., can be used. As illustrated in FIGS. 1 to 3, one end of the signal line 30 is connected to a feed point for the patch conductor 20 through a pillar-shaped feed conductor 41 extending in the z-direction, and the other end thereof is connected to an exterior RF circuit 100 through a pillar-shaped feed conductor 42 extending in the z-direction. In the present embodiment, the shape of the signal line 30 is an L-shape including a part extending in the x-direction and a part extending in the y-direction, but not particularly limited thereto.

The feed conductor 41 penetrates through the opening G1*a* formed in the first ground pattern G1 and is connected to the feed point positioned within a predetermined surface of the patch conductor 20. The feed conductor 42 penetrates through the opening G2*a* formed in the second ground pattern G2 and is connected to the RF circuit 100. The RF circuit 100 is an external circuit that outputs an antenna signal. When the signal line 30 is a microstripline, the second ground pattern G2 serves as a reference plane with respect to the signal line 30. When the signal line 30 is a stripline, the first and second ground patterns G1 and G2 serve as reference planes with respect to the signal line 30.

Figure 4A:
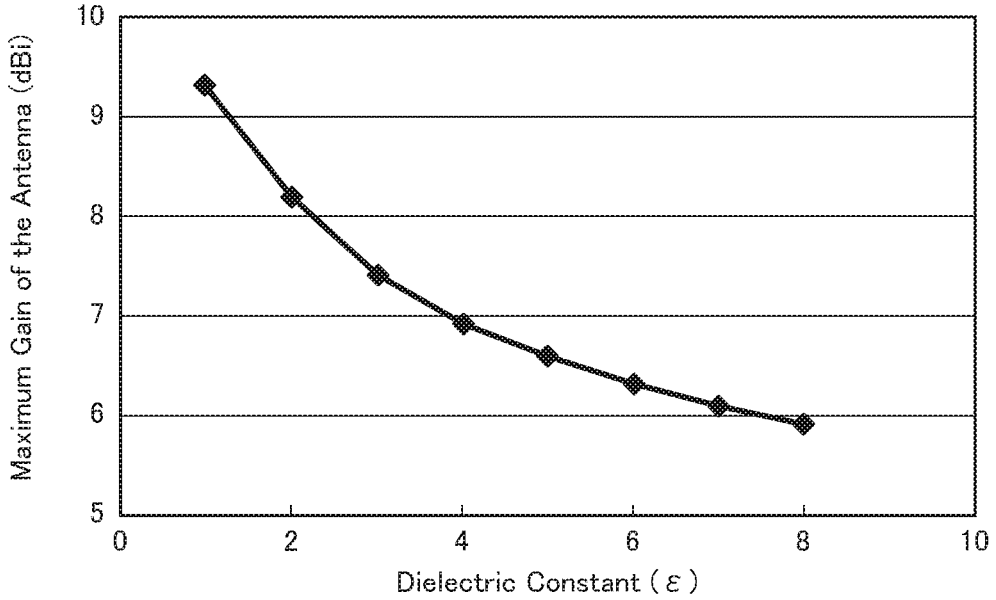
FIG. 4A is a graph illustrating the relationship between the dielectric constant of the first dielectric layer and a maximum gain of the antenna.
Figure 4B:
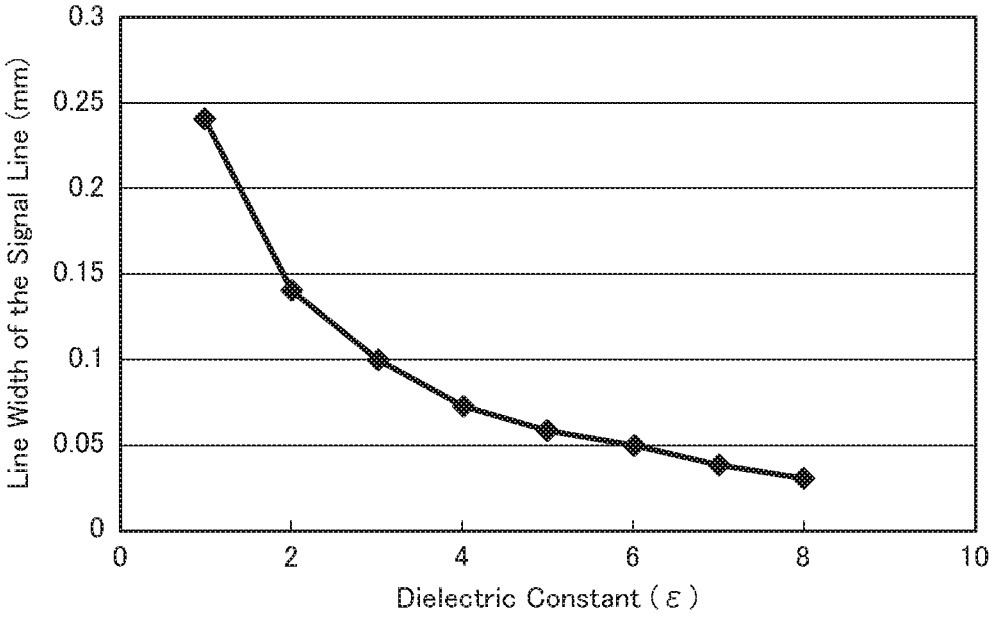
FIG. 4B is a graph illustrating the relationship between the dielectric constant of the second dielectric layer and the line width of the signal line.

FIG. 4A is a graph illustrating the relationship between the dielectric constant of the first dielectric layer D1 and a maximum gain of the antenna. FIG. 4B is a graph illustrating the relationship between the dielectric constant of the second dielectric layer D2 and the line width of the signal line 30.

The maximum gain of the antenna illustrated in FIG. 4A is a value obtained when the planar size of the patch conductor 20 is adjusted so as to set the center frequency to 30 GHz under the conditions that the thickness of the patch conductor 20 is 0.018 mm, the thickness of the first dielectric layer D1 is 0.5 mm, and the planar size of the first ground pattern G1 is 10 mm×10 mm. As illustrated in FIG. 4A, the lower the dielectric constant of the first dielectric layer D1 is, the more satisfactory the maximum gain of the antenna becomes. Particularly, in a region where a dielectric constant ε is 2 or lower, the maximum gain can be made to exceed 8 dBi.

The line width illustrated in FIG. 4B is a value required for characteristic impedance to be 50Ω under the conditions that the signal line 30 is a stripline with a thickness of 0.018 mm and the thickness of the second dielectric layer D2 is 0.2 mm. As illustrated in FIG. 4B, the higher the dielectric constant of the second dielectric layer D2 is, the smaller the line width of the signal line 30 required for the characteristic impedance to be 50Ω becomes. Particularly, in a region where a dielectric constant ε is 6 or higher, the line width can be made 0.05 mm or smaller.

In the patch antenna 10A according to the present embodiment, the first and second dielectric layers D1 and D2 are made of mutually different materials, so that the dielectric constant of the first dielectric layer D1 and the dielectric constant of the second dielectric layer D2 can be set as desired independently of each other. Thus, when a low dielectric constant material is selected as the material of the first dielectric layer D1, and a high dielectric constant material is selected as the material of the second dielectric layer D2, it is possible to reduce the line width of the signal line 30 while ensuring high antenna characteristics. FIGS. 1 to 3 illustrate a case where the pattern shape of the signal line 30 is comparatively simple; however, according to the present embodiment, the line width of the signal line 30 can be reduced, allowing the pattern shape of the signal line 30 to be more complicated. Further, circuit elements, including filters, can be formed by the conductor pattern formed in the second dielectric layer D2.

Figure 5:
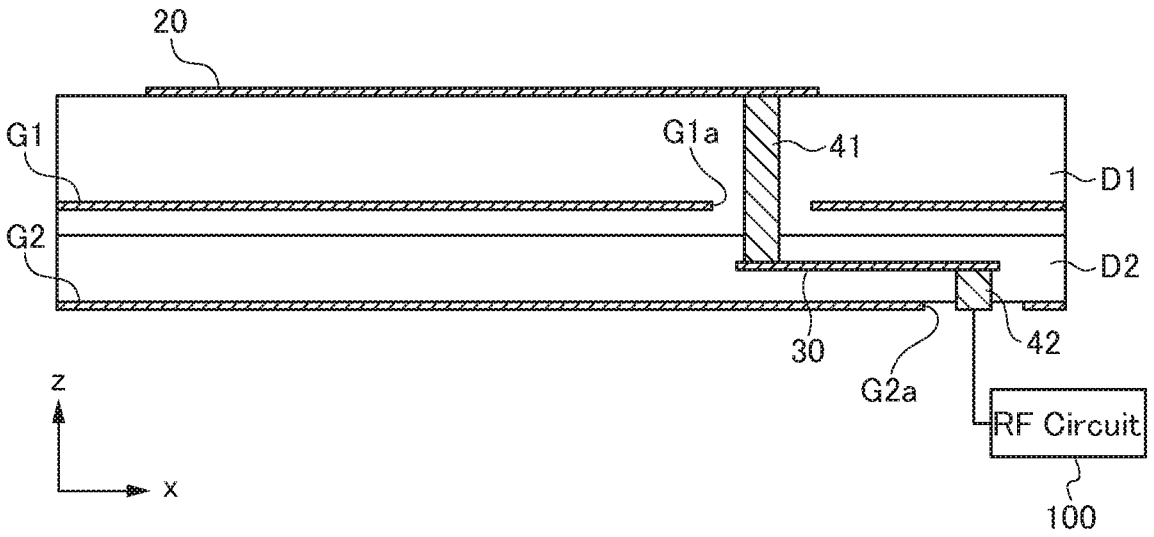
FIG. 5 is a schematic transparent perspective view of a patch antenna according to a first modification of the patch antenna shown in FIG. 1.
Figure 6:
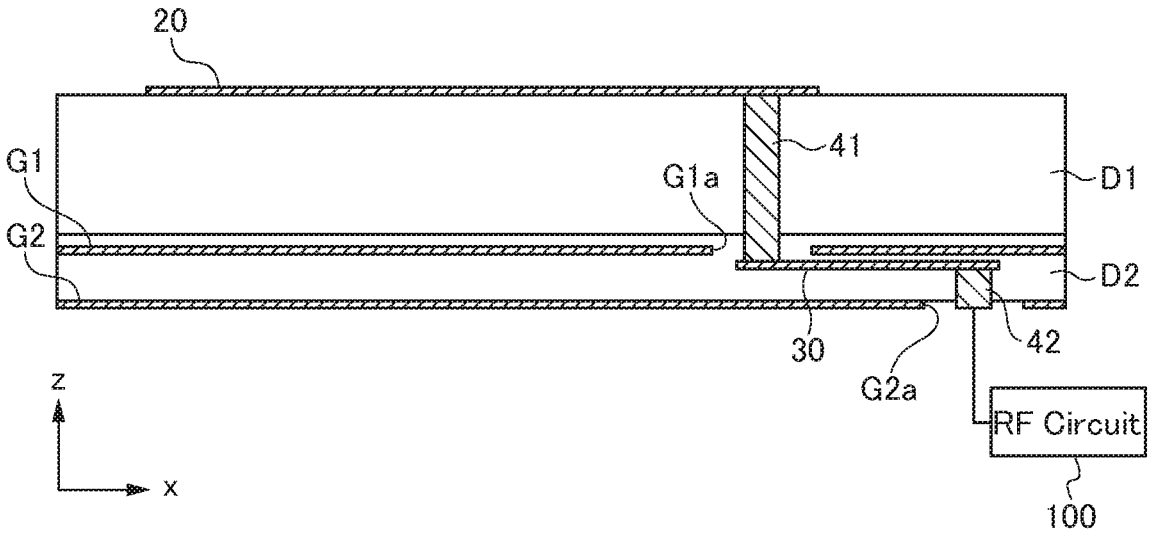
FIG. 6 is a schematic transparent perspective view of a patch antenna according to a second modification of the patch antenna shown in FIG. 1.
Figure 7:
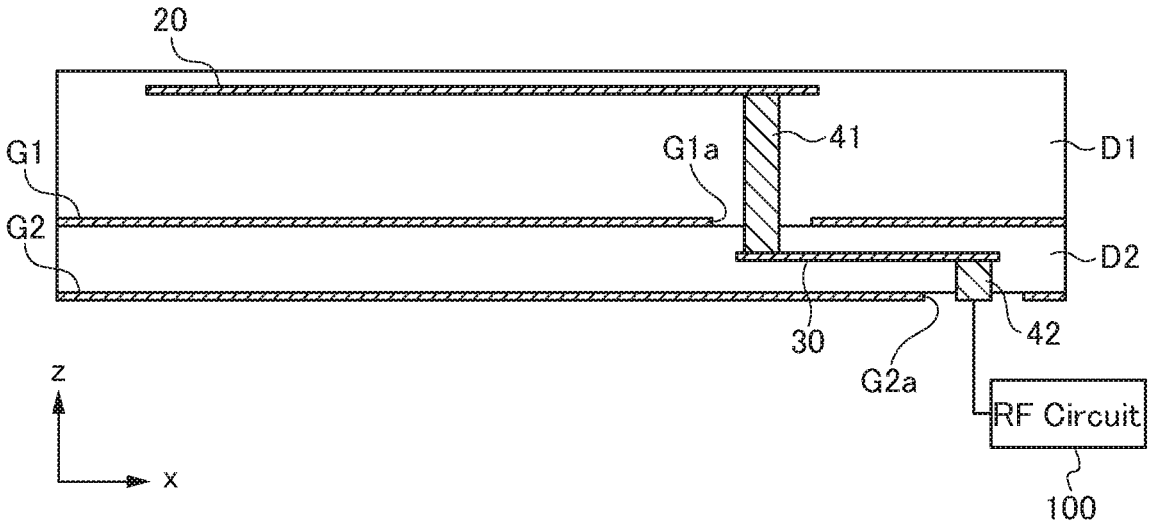
FIG. 7 is a schematic transparent perspective view of a patch antenna according to a third modification of the patch antenna shown in FIG. 1.
Figure 8:
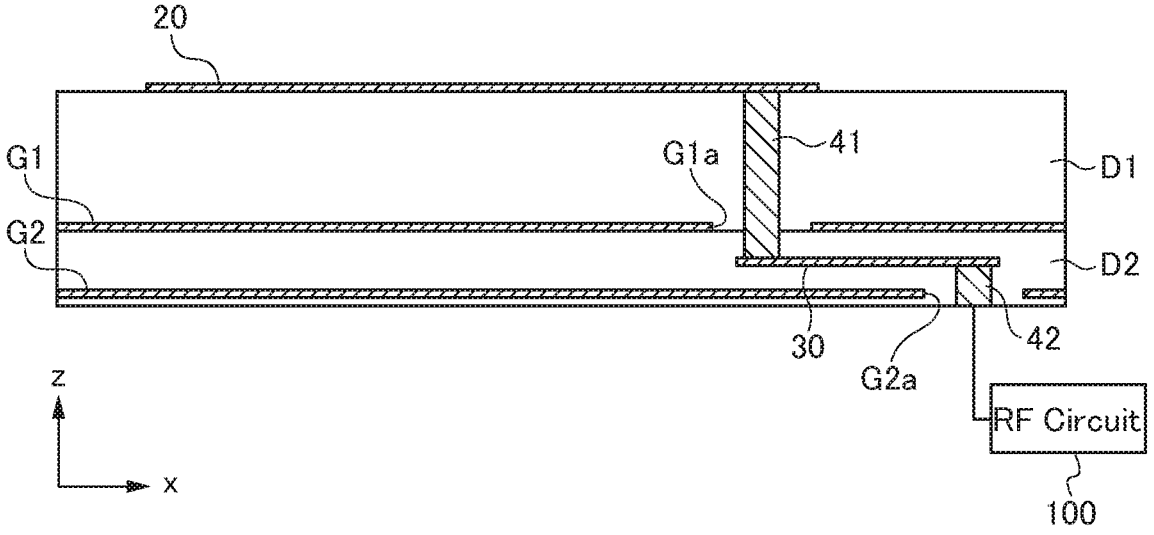
FIG. 8 is a schematic transparent perspective view of a patch antenna according to a fourth modification of the patch antenna shown in FIG. 1.

In the present invention, the positions of the first and second ground patterns G1, G2 and patch conductor 20 in the z-direction are not limited to those illustrated in FIGS. 1 to 3. For example, the first ground pattern G1 may be offset to the first dielectric layer D1 side as illustrated in FIG. 5, or the first ground pattern G1 may be offset to the second dielectric layer D2 side as illustrated in FIG. 6. That is, it is only necessary for the first ground pattern G1 to be disposed between the patch conductor 20 and the signal line 30. Further, as illustrated in FIG. 7, the patch conductor 20 may be disposed inside the first dielectric layer D1, and the both surfaces thereof may be covered with the first dielectric layer D1. Further, as illustrated in FIG. 8, the second ground pattern G2 may be disposed inside the second dielectric layer D2, and the both surfaces thereof may be covered with the second dielectric layer D2.

Second Embodiment

Figure 9:
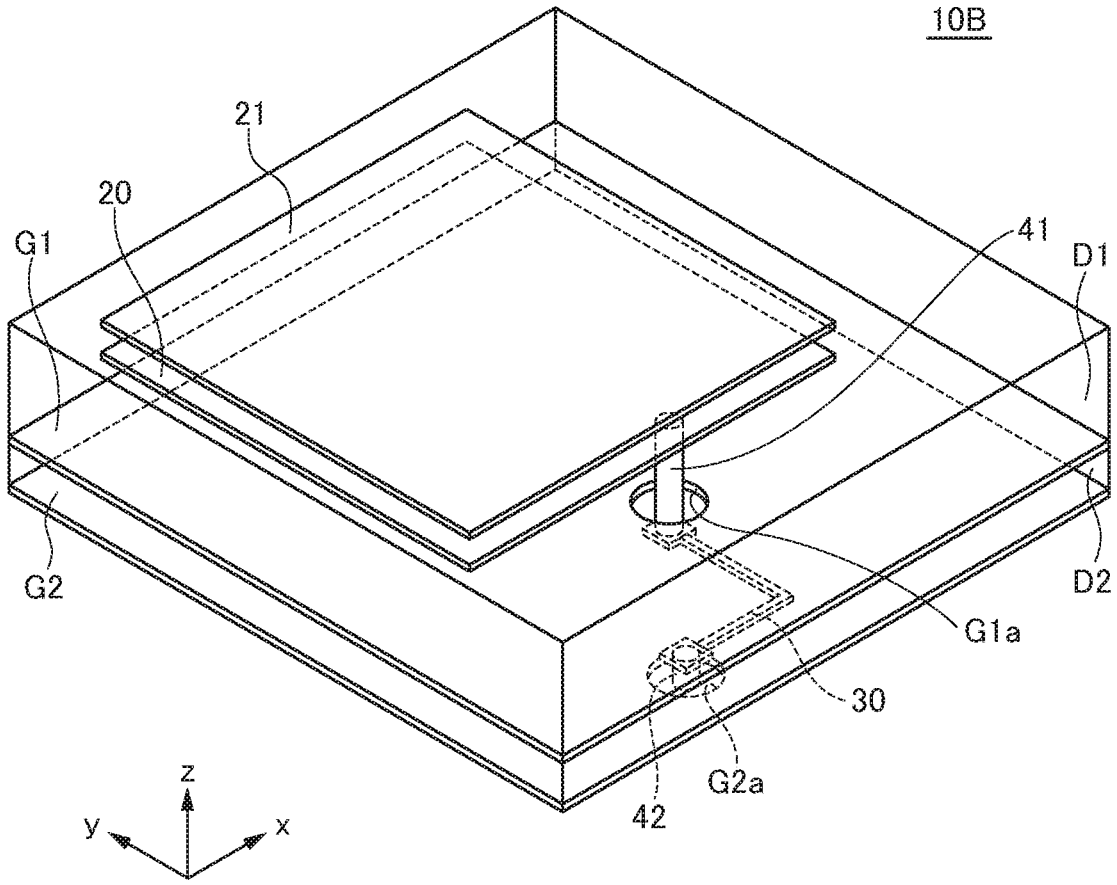
FIG. 9 is a schematic transparent perspective view of a patch antenna according to a second embodiment of the present invention.
Figure 10:
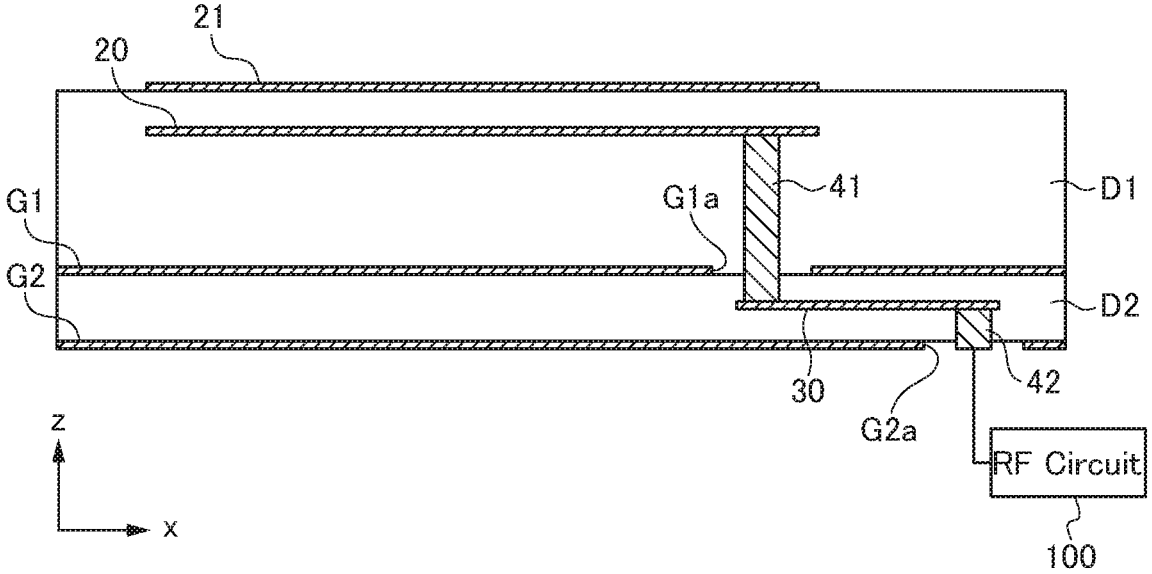
FIG. 10 is a schematic transparent side view of the patch antenna shown in FIG. 9.

FIG. 9 is a schematic transparent perspective view of a patch antenna 10B according to the second embodiment of the present invention. FIG. 10 is a schematic transparent side view of the patch antenna 10B.

As illustrated in FIGS. 9 and 10, the patch antenna 10B according to the second embodiment differs from the patch antenna 10A according to the first embodiment in that a parasitic patch conductor 21 is added to the first dielectric layer D1. Other configurations are basically the same as those of the patch antenna 10A according to the first embodiment, so the same reference numerals are given to the same elements, and overlapping description will be omitted.

The parasitic patch conductor 21 is a rectangular conductor pattern provided above the patch conductor 20 so as to overlap the patch conductor 20. The parasitic patch conductor 21 is not connected to any conductor pattern and is in a DC floating state. When the parasitic patch conductor 21 is added to the first dielectric layer D1, antenna bandwidth can be further extended. In the example illustrated in FIGS. 9 and 10, the patch conductor 20 and parasitic patch conductor 21 have the same planar size; however, the sizes of the patch conductor 20 and parasitic patch conductor 21, distance between the patch conductor 20 and the parasitic patch conductor 21 may be appropriately adjusted according to required antenna characteristics.

Third Embodiment

Figure 11:
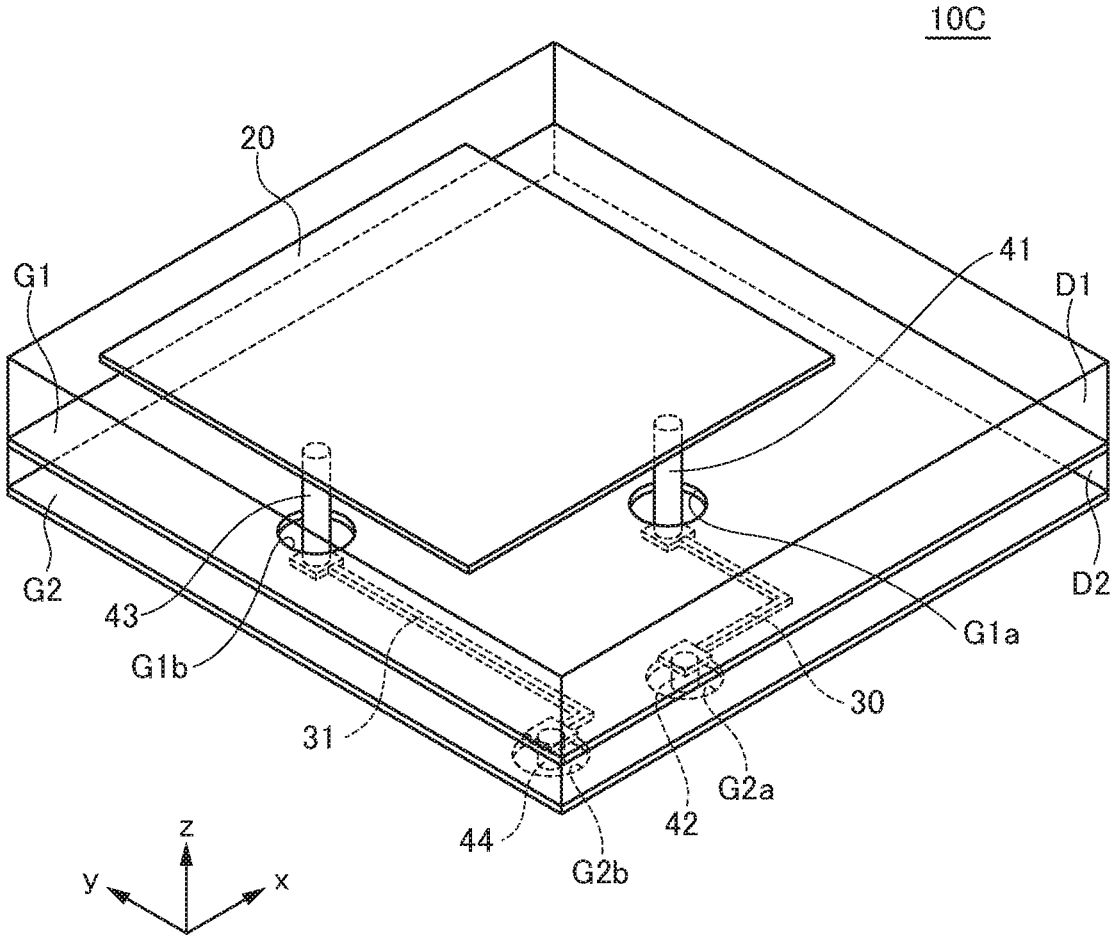
FIG. 11 is a schematic transparent perspective view of a patch antenna according to a third embodiment of the present invention.

FIG. 11 is a schematic transparent perspective view of a patch antenna 10C according to the third embodiment of the present invention.

As illustrated in FIG. 11, the patch antenna 10C according to the third embodiment additionally has a signal line 31 provided in the second dielectric layer D2. One end of the signal line 31 is connected to a pillar-shaped feed conductor 43 extending in the z-direction, and the other end thereof is connected to a pillar-shaped feed conductor 44 extending in the z-direction. The feed conductor 43 penetrates an opening G1*b* formed in the first ground pattern G1 and is connected to another feed point positioned within a predetermined surface of the patch conductor 20. The feed conductor 44 penetrates an opening G2*b* formed in the second ground pattern G2 and is connected to a not-shown RF circuit. Other configurations are basically the same as those of the patch antenna 10A according to the first embodiment, so the same reference numerals are given to the same elements, and overlapping description will be omitted.

The feed conductors 41 and 43 are connected to mutually different plane positions of the patch conductor 20. In the example of FIG. 11, the feed conductor 41 is connected near the side of the patch conductor 20 extending in the x-direction, and the feed conductor 43 is connected near the side of the patch conductor 20 extending in the y-direction. As a result, the patch antenna 10C according to the present embodiment functions as a dual-polarized antenna. For example, a horizontally polarized signal can be fed through the signal line 30, and a vertically polarized signal can be fed through the signal line 31. The signal lines 30 and 31 may be formed in the same wiring layer or mutually different wiring layers.

Fourth Embodiment

Figure 12:
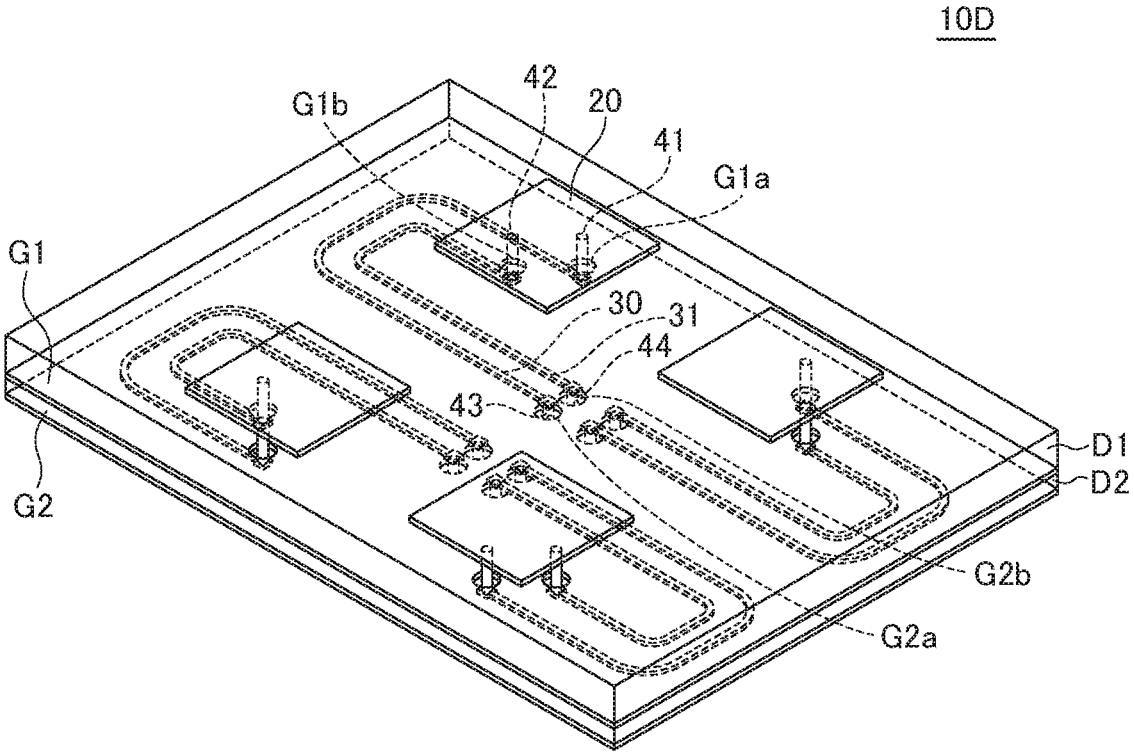
FIG. 12 is a schematic transparent perspective view of a patch antenna according to a fourth embodiment of the present invention.
Figure 13:
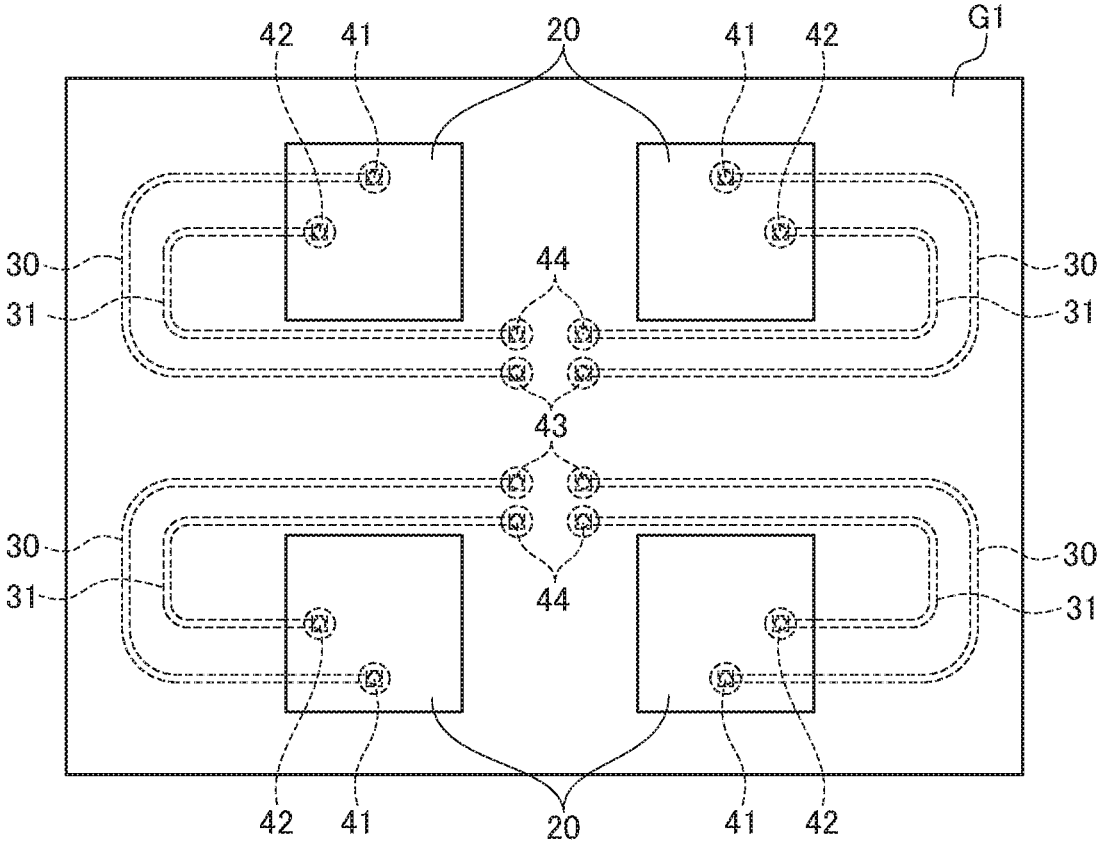
FIG. 13 is a schematic transparent plan view of the patch antenna shown in FIG. 12.

FIG. 12 is a schematic transparent perspective view of a patch antenna 10D according to the fourth embodiment of the present invention. FIG. 13 is a schematic transparent plan view of the patch antenna 10D, and FIG. 14 is a schematic transparent side view of the patch antenna 10D.

Figure 14:
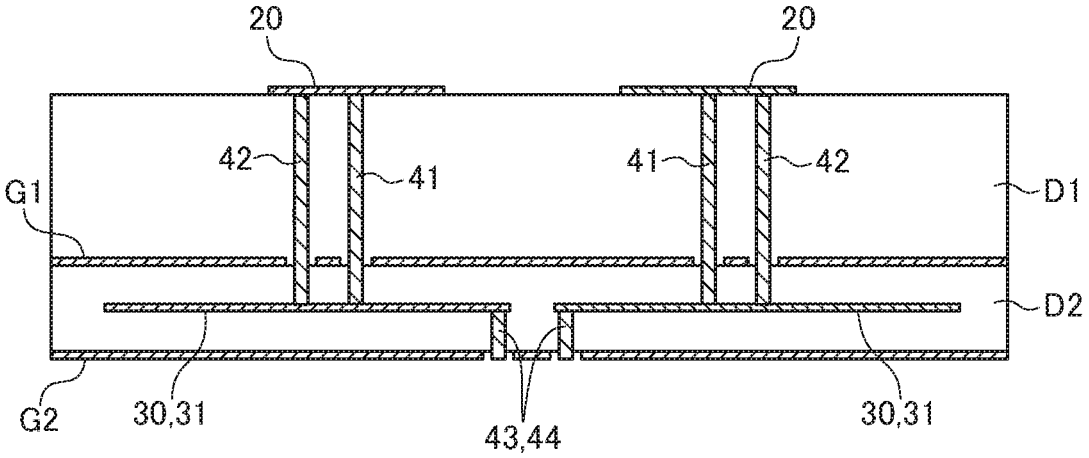
FIG. 14 is a schematic transparent side view of the patch antenna shown in FIG. 12.

As illustrated in FIGS. 12 to 14, the patch antenna 10D according to the present embodiment has four patch conductors 20. Other configurations are basically the same as those of the patch antenna 10C according to the third embodiment, so the same reference numerals are given to the same elements, and overlapping description will be omitted. As exemplified by the patch antenna 10D according to the present embodiment, when a plurality of sets of the patch conductor 20, signal lines 30, 31, and feeding conductors 41 to 44 are arranged in an array, a so-called phased array antenna can be obtained. Although four patch conductors 20 are arranged in a matrix in the example illustrated in FIGS. 12 to 14, they may be arranged in one direction.

Fifth Embodiment

Figure 15:
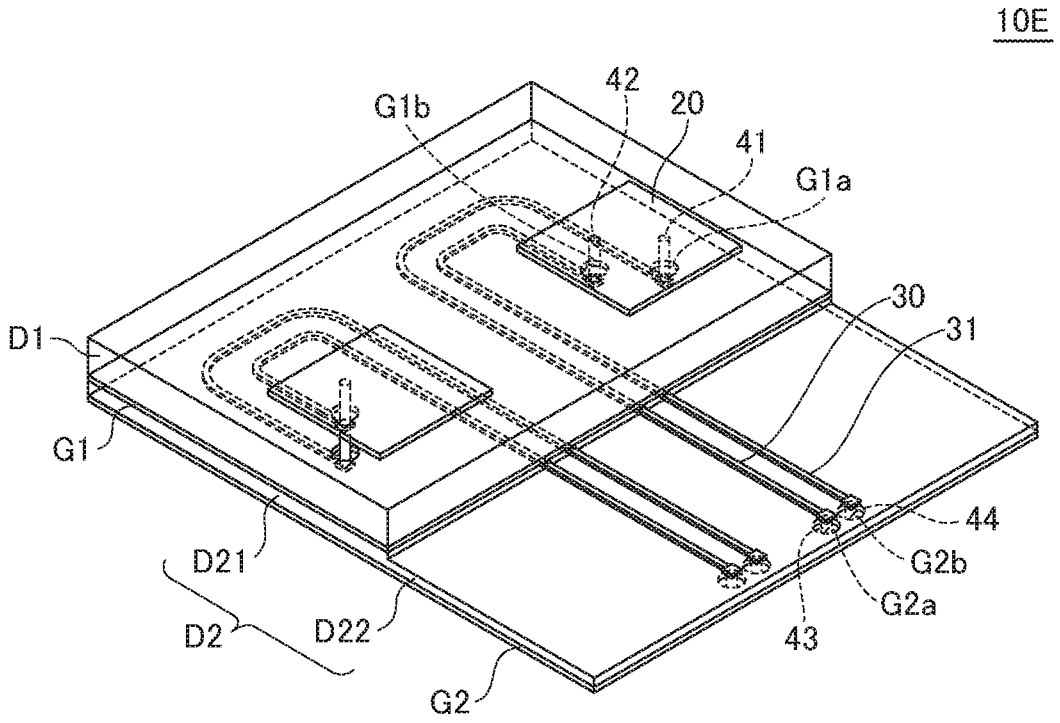
FIG. 15 is a schematic transparent perspective view of a patch antenna according to a fifth embodiment of the present invention.
Figure 16:
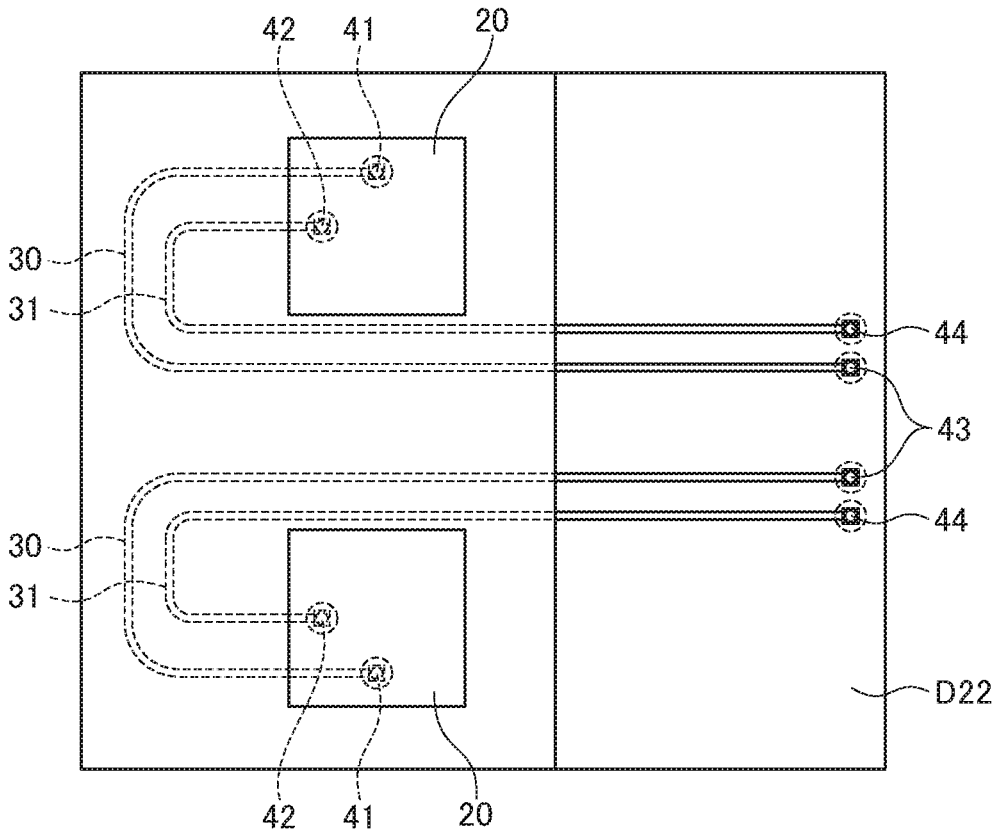
FIG. 16 is a schematic transparent plan view of the patch antenna shown in FIG. 15.

FIG. 15 is a schematic transparent perspective view of a patch antenna 10E according to the fifth embodiment of the present invention. FIG. 16 is a schematic transparent plan view of the patch antenna 10E, and FIG. is a schematic transparent side view of the patch antenna 10E.

Figure 17:
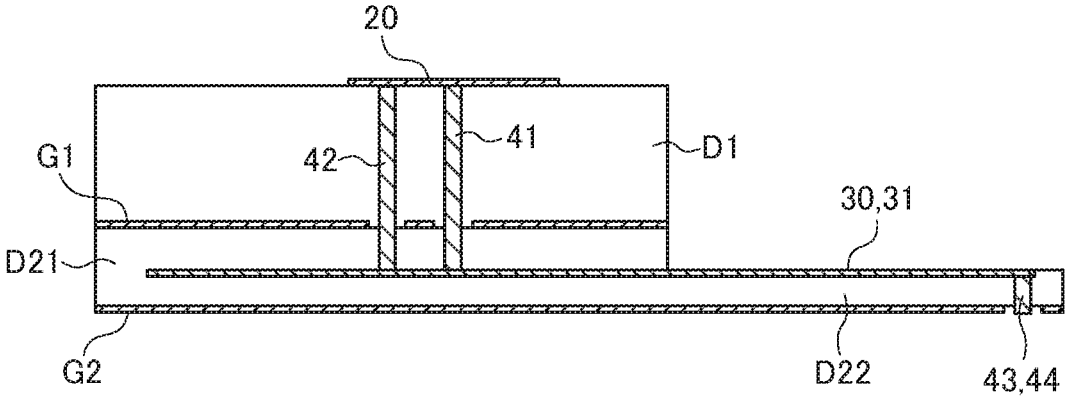
FIG. 17 is a schematic transparent side view of the patch antenna shown in FIG. 15.

As illustrated in FIGS. 15 to 17, the patch antenna 10E according to the present embodiment has two patch conductors 20 and a step-shaped second dielectric layer D2. Other configurations are basically the same as those of the patch antennas 10C and 10D according to the third and fourth embodiments, so the same reference numerals are given to the same elements, and overlapping description will be omitted.

In the present embodiment, the second dielectric layer D2 has a first region D21 having a large thickness and a second region D22 having a thickness smaller than that of the first region D21. The first dielectric layer D1 is selectively provided on the first region D21 of the second dielectric layer D2. That is, the first dielectric layer D1 is not provided on the second region D22 of the second dielectric layer D2. The signal lines 30 and 31 are formed over the first and second regions D21 and D22 and are exposed in the second region D22. The feed conductors 43 and 44 are disposed in the second region D22.

Thus, in the present embodiment, the first dielectric layer D1 is not provided on the second region D22 of the second dielectric layer D2, and the thickness of the second region D22 is small, allowing the second dielectric layer D2 to have flexibility. Thus, when the patch antenna 10E is mounted in a target device, the second region D22 can be bent following the shape of the device. In the present embodiment, the feed conductors 43 and 44 as terminal electrodes are disposed in the second region D22, so that even when a surface (e.g., xy plane) on which the patch conductor 20 is disposed and the connection surface (e.g., xz plane) of the terminal electrode are not flush with each other, the patch antenna 10E can be easily mounted by bending the flexible second region D22.

It is apparent that the present invention is not limited to the above embodiments, but may be modified and changed without departing from the scope and spirit of the invention.

What is claimed is:

1. A patch antenna comprising:

a first dielectric layer in which a patch conductor is provided;

a second dielectric layer in which a first signal line extending in a direction parallel to the patch conductor is provided;

a first feed conductor provided perpendicularly to the patch conductor so as to connect one end of the first signal line and a first feed point for the patch conductor;

a first ground pattern provided between the patch conductor and the first signal line; and a second ground pattern provided inside the second dielectric layer such that the first signal line is sandwiched between the first and second dielectric layers, the second ground pattern having a first opening; and a second feed conductor penetrating through the first opening, the second feed conductor being connected to other end of the first signal line, wherein the first and second feed conductors are different in planar position from each other, wherein the first dielectric layer has a dielectric constant lower than that of the second dielectric layer, and wherein the dielectric constant of the second dielectric layer is 6 or more.

2. The patch antenna as claimed in claim 1, wherein the first ground pattern is disposed on a boundary surface between the first and second dielectric layers.

3. The patch antenna as claimed in claim 1, wherein the patch conductor is disposed on an outermost surface of the first dielectric layer.

4. The patch antenna as claimed in claim 1, wherein the second ground pattern is disposed on an outermost surface of the second dielectric layer.

5. The patch antenna as claimed in claim 1, further comprising a parasitic patch conductor provided in the first dielectric layer so as to overlap the patch conductor.

6. The patch antenna as claimed in claim 1, further comprising:

a second signal line provided in the second dielectric layer; and a third feed conductor provided perpendicularly to the patch conductor and connecting one end of the second signal line and a second feed point for the patch conductor;

a fourth feed conductor penetrating through a second opening of the second ground pattern, the fourth feed conductor being connected to other end of the second signal line, wherein the third and fourth feed conductors are different in planar position from each other.

7. The patch antenna as claimed in claim 1, wherein a plurality of sets of the patch conductor, first signal line, and first and second feed conductors are provided in an array.

8. The patch antenna as claimed in claim 1, wherein the second dielectric layer has a first region and a second region having a thickness smaller than that of the first region, wherein the first dielectric layer is provided on the first region of the second dielectric layer, and wherein the first signal line is formed over the first and second regions of the second dielectric layer.

9. The patch antenna as claimed in claim 8, wherein a side surface of the second dielectric layer positioned between the first and second regions is exposed.

10. The patch antenna as claimed in claim 8, wherein the one end of the first signal line is located at the first region, and wherein the other end of the first signal line is located at the second region.

11. The patch antenna as claimed in claim 1, wherein the first signal line is a microstripline, a stripline, or a coplanar waveguide line.

12. The patch antenna as claimed in claim 1, wherein the dielectric constant of the first dielectric layer is 2 or less.

13. The patch antenna as claimed in claim 1, wherein the first dielectric layer has a lower surface facing to the second dielectric layer and an upper surface positioned opposite to the lower surface, and wherein the upper surface of the first dielectric layer is exposed without covered with any dielectric layer.

14. A patch antenna comprising:

a first dielectric layer having a first dielectric constant;

a second dielectric layer having a second dielectric constant higher than the first dielectric constant, the second dielectric constant being 6 or more;

a patch conductor provided on the first dielectric layer;

a first ground pattern provided between the first and second dielectric layers, the first ground pattern having a first opening;

a second ground pattern formed embedded in the second dielectric layer, the second ground pattern having a second opening;

a signal line embedded in the second dielectric layer such that the signal line is sandwiched between the first and second ground patterns;

a first feed conductor penetrating through the first opening, the first feed conductor having a first end connected to the patch conductor and a second end connected to one end of the signal line; and a second feed conductor penetrating through the second opening, the second feed conductor having a first end connected to other end of the signal line, wherein the first and second feed conductors are different in planar position from each other.

15. The patch antenna as claimed in claim 14, wherein the first dielectric constant is 2 or less.

16. The patch antenna as claimed in claim 14, wherein the signal line has a first section extending in a first direction and a second section extending in a second direction different from the first direction.

17. The patch antenna as claimed in claim 14, wherein the second dielectric layer has a first region and a second region having a thickness smaller than that of the first region, wherein the first dielectric layer is selectively formed on the first region of the second dielectric layer without covering the second region of the second dielectric layer, wherein the first ground pattern is selectively formed on the first region of the second dielectric layer without covering the second region of the second dielectric layer, and wherein the second ground pattern is formed over the first and second regions of the second dielectric layer.

18. The patch antenna as claimed in claim 17, wherein the signal line is formed over the first and second regions of the second dielectric layer.

19. The patch antenna as claimed in claim 17, wherein a side surface of the second dielectric layer positioned between the first and second regions is exposed.

20. The patch antenna as claimed in claim 17, wherein the one end of the signal line is located at the first region, and wherein the other end of the signal line is located at the second region.

* * * * *